US007513248B2

(12) United States Patent
Ng et al.

(10) Patent No.: US 7,513,248 B2
(45) Date of Patent: Apr. 7, 2009

(54) APPLIANCE EXHAUST DUCT COVER AND METHOD OF ASSEMBLING SAME

(75) Inventors: Chang C. Ng, Prospect, KY (US); A. Nolan Pike, IV, Louisville, KY (US); Andrew Joseph Spanyer, Louisville, KY (US)

(73) Assignee: General Electric Company, Schenectady, NY (US)

( * ) Notice: Subject to any disclaimer, the term of this patent is extended or adjusted under 35 U.S.C. 154(b) by 310 days.

(21) Appl. No.: 10/914,522

(22) Filed: Aug. 9, 2004

(65) Prior Publication Data

US 2006/0027231 A1 Feb. 9, 2006

(51) Int. Cl.
*F24C 15/20* (2006.01)

(52) U.S. Cl. ..... 126/299 R; 454/49; 454/50

(58) Field of Classification Search ..... 126/299 R, 126/299 D, 82, 300, 299 F, 307 R, 312, 80, 126/315; 454/49, 50, 51
See application file for complete search history.

(56) References Cited

U.S. PATENT DOCUMENTS

| | | | | |
|---|---|---|---|---|
| 1,919,407 | A * | 7/1933 | Wood | 126/59.5 |
| 2,199,875 | A * | 5/1940 | Brogden | 236/96 |
| 4,462,387 | A | 7/1984 | Welsh | |
| 4,614,177 | A | 9/1986 | Buckley et al. | |
| 4,987,882 | A | 1/1991 | Kaufman | |
| 5,322,470 | A | 6/1994 | Vartiainen et al. | |
| 5,662,097 | A | 9/1997 | Panos | |
| 5,791,985 | A * | 8/1998 | Schiedegger et al. | 454/339 |
| 5,890,484 | A * | 4/1999 | Yamada | 126/299 R |
| 6,053,162 | A * | 4/2000 | Godfree et al. | 126/85 B |
| 6,125,838 | A * | 10/2000 | Hedgpeth | 126/41 R |
| 6,202,638 | B1 | 3/2001 | Didio-Sayer | |
| D468,159 | S | 1/2003 | Becker et al. | |
| D468,961 | S | 1/2003 | Becker et al. | |
| 6,557,545 | B2 * | 5/2003 | Williams | 126/25 R |
| 6,647,978 | B1 | 11/2003 | Khosropour et al. | |
| 6,715,484 | B2 * | 4/2004 | Khosropour et al. | 126/299 R |
| 2002/0195097 | A1 * | 12/2002 | Lesage | 126/85 B |
| 2006/0027229 | A1 * | 2/2006 | Bass | 126/25 R |

* cited by examiner

*Primary Examiner*—Kenneth B Rinehart
*Assistant Examiner*—Chuka C Ndubizu
(74) *Attorney, Agent, or Firm*—George L. Rideout, Esq.; Armstrong Teasdale LLP

(57) ABSTRACT

An appliance vent duct cover includes a first cover portion, and a second cover portion including a plurality of openings, wherein the second cover portion is slidably coupled to the first cover portion such that the second cover portion is selectively positionable with respect to the first cover portion to enable the plurality of openings to be substantially covered by the first cover portion.

20 Claims, 3 Drawing Sheets

APPLIANCE EXHAUST DUCT COVER AND METHOD OF ASSEMBLING SAME

BACKGROUND OF THE INVENTION

This invention relates generally to an appliance exhaust system, and, more particularly, to a method and apparatus for an appliance exhaust duct cover.

At least some known ovens include an oven cavity, at least one heating element in the oven cavity, and a plurality of electric heating elements and/or gas burners on an upper surface of the oven. The heating elements and/or gas burners facilitate cooking food positioned on the heating elements and/or gas burners. During the cooking process, undesirable gases and/or fumes may be generated by the heating elements and/or gas burners in the cooking area and subsequently released into the surrounding environment.

To facilitate reducing the release of such gases and/or fumes into the environment, at least some known ovens include a separate venting system, e.g. a range hood, positioned above the oven. Known range hoods include an electric fan/blower that channels the gases and/or fumes generated during the cooking process through a vent duct, wherein the gases and/or fumes are either filtered and re-circulated back into the kitchen, i.e. ductless venting, or released directly to the outside atmosphere, i.e. ducted venting. Typically, the appliance owner selects whether the range hood should be configured to re-circulate the gases and/or fumes, or discharge the gases and/or fumes directly to the environment, and the vent duct is then permanently installed for the desired configuration. More specifically, if the owner selects a re-circulated configuration a vent duct that includes a plurality of openings within the kitchen is installed. Alternatively, if the owner selects to discharge the gases and/or fumes directly to the environment, i.e. a non-re-circulated configuration, a vent duct that does not include a plurality of openings is installed.

Since the gases and/or fumes may contain moisture, at least one known vent duct is fabricated from a galvanized metallic material. To increase the aesthetics of an exposed vent duct within a kitchen, for example, a one-piece vent duct cover may be positioned over an exterior surface of the galvanized metallic vent duct. However, different venting configurations require the use of different duct covers. For example, a one-piece vent duct cover used with a re-circulated vent duct may not be utilized as a vent duct cover with a non-recirculated configuration. Fabricating multiple vent duct covers not only increases design and fabrication costs, but also increases the quantity of parts that must be maintained by the appliance vendors and the likelihood of an incorrect vent duct cover being installed.

BRIEF DESCRIPTION OF THE INVENTION

In one aspect, a method for assembling an appliance vent duct cover assembly is provided. The method includes providing a first cover portion, slidably coupling a second cover portion to the first cover portion, the second cover portion including a plurality of openings, and selectively positioning the second cover portion with respect to the first cover portion to enable the openings to be substantially covered by the first cover portion.

In another aspect, an appliance vent duct cover assembly is provided. The vent duct cover assembly includes a first cover portion, and a second cover portion including a plurality of openings, wherein the second cover portion is slidably coupled to the first cover portion such that the second cover portion is selectively positionable with respect to the first cover portion to enable the plurality of openings to be substantially covered by the first cover portion.

In a further aspect, an appliance range hood is provided. The appliance range hood includes a vent duct coupled to the range hood. The vent duct extends from an upper surface of the range hood to a ceiling. The appliance range hood also includes a vent duct cover assembly at least partially circumscribing the vent duct. The vent duct cover assembly includes a first cover portion, and a second cover portion including a plurality of openings, wherein the second cover portion is slidably coupled to the first cover portion such that the second cover portion is selectively positionable with respect to the first cover portion to enable the openings to be substantially covered by the first cover portion.

DETAILED DESCRIPTION OF THE INVENTION

Figure 1:
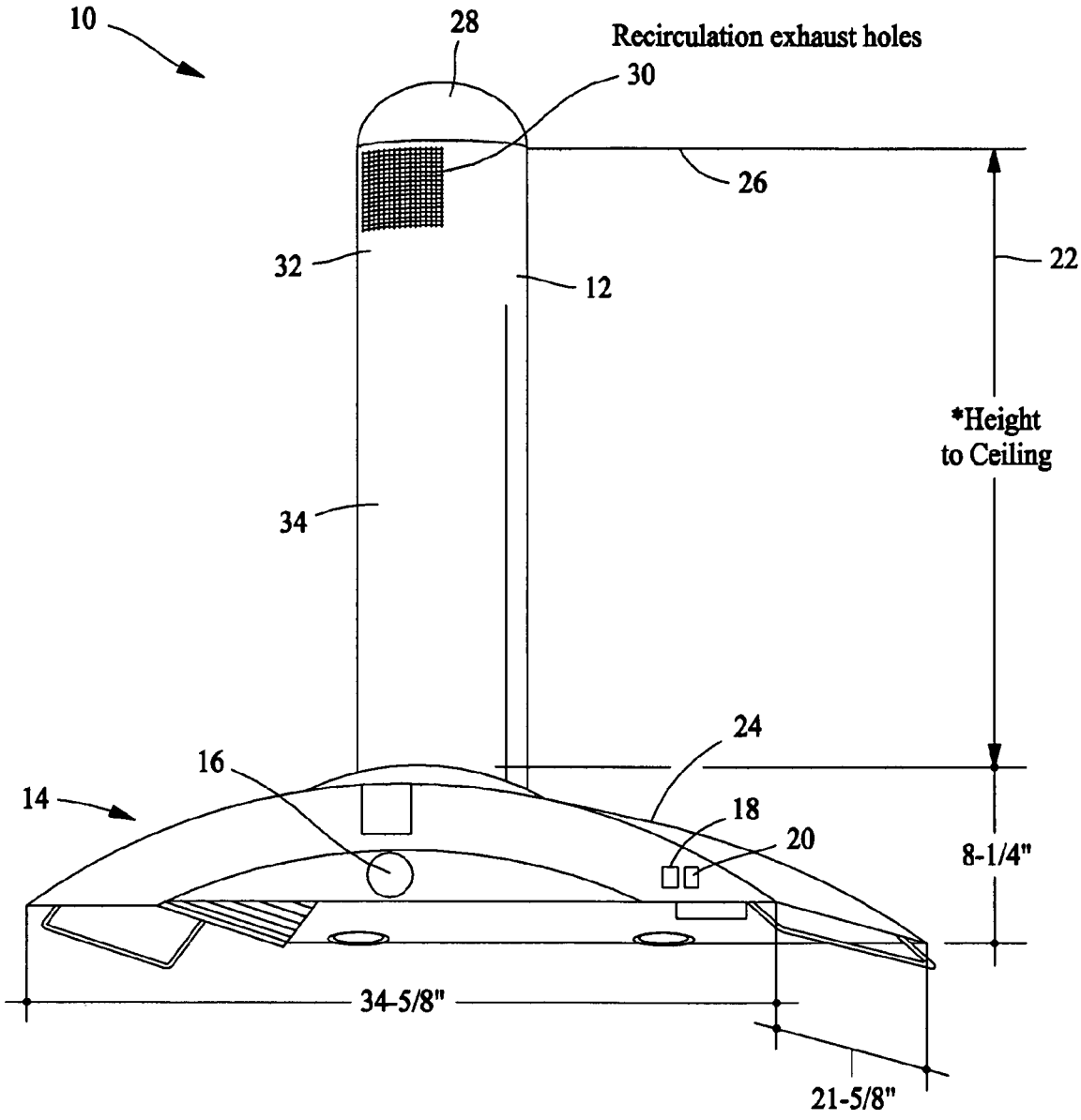
FIG. 1 is a perspective view of an exemplary appliance range hood and vent duct.

FIG. 1 is a perspective view of an exemplary appliance range hood 10 and vent duct 12. Range hood 10 includes a generally box-like structure 14 open at the bottom, a fan/blower assembly 16, an on/off light switch 18, and a fan speed control switch 20. In the exemplary embodiment, range hood 10 is suitably dimensioned for installation above a kitchen range and includes attachment portions (not shown) for mounting to an overhang, such as the bottom of a kitchen cabinet, or a ceiling. In one embodiment, the attachment portions are keyslots.

Vent duct 12 includes a length 22 that extends from an upper surface 24 of range hood 10 and a ceiling 26. In the exemplary embodiment, vent duct 12 has a cross-sectional profile 28 that is substantially circular. Although vent duct 12 is described in the exemplary embodiment as having a substantially circular cross-sectional profile. In other embodiments, vent duct 12 has a cross-section profile that is not circular. For example, vent duct 12 may have a substantially square or rectangular cross-sectional profile. In the exemplary embodiment, vent duct 12 is fabricated from a galvanized sheet metal for example and is secured to range hood 10 using a plurality of fasteners (not shown).

In one embodiment, vent duct 12 is configured for ductless operation and includes a plurality of re-circulation exhaust holes 30 positioned at a first end 32 of vent duct 12. In another embodiment, vent duct 12 is configured for ducted operation and does not include a plurality of re-circulation exhaust holes 30 at first end 32 of vent duct 12, rather vent duct 12 includes a substantially solid outer surface 34.

Figure 2:
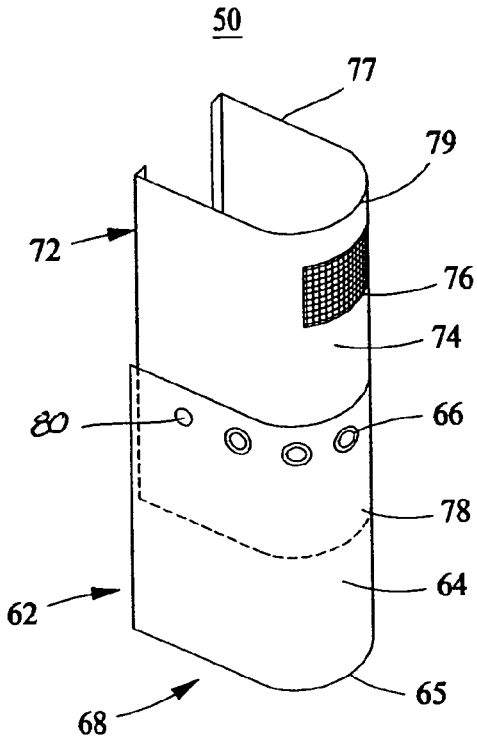
FIG. 2 is a perspective view of a vent duct cover assembly assembled in a ductless configuration.
Figure 3:
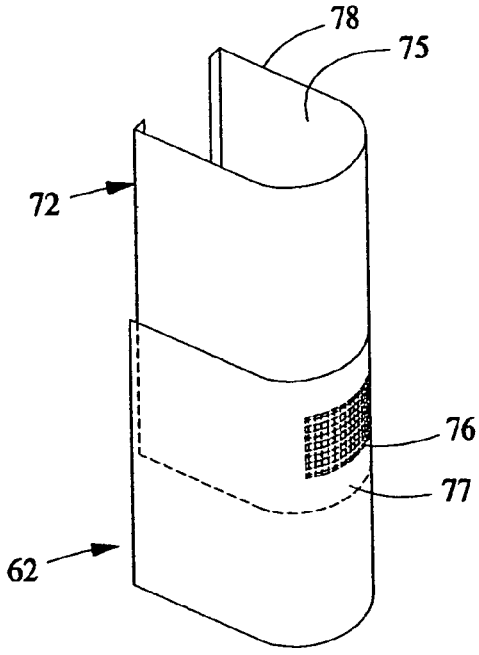
FIG. 3 is a perspective view of the vent duct cover assembly shown in FIG. 2 assembled in a ducted configuration.
Figure 4:
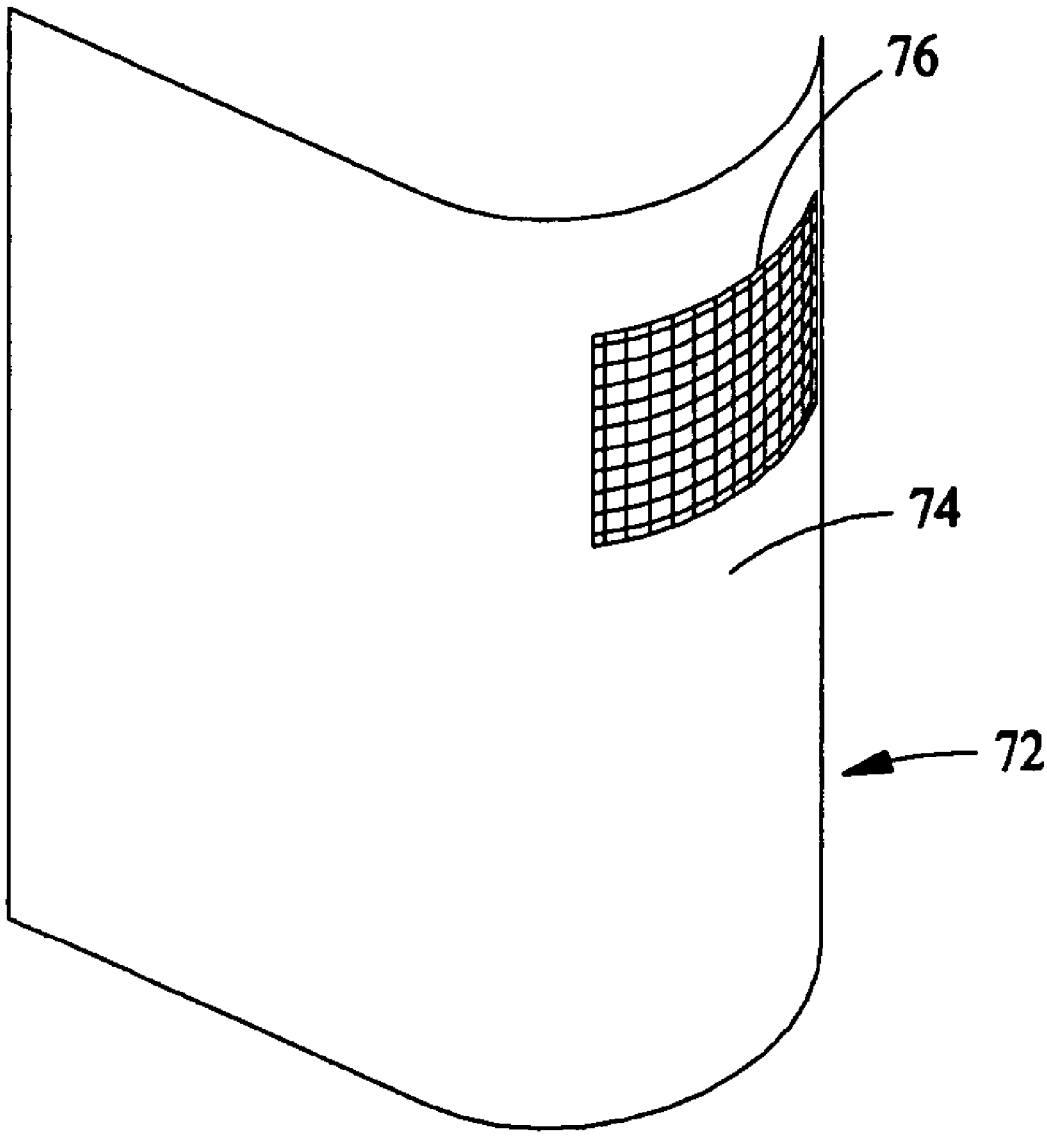
FIG. 4 is a perspective view of a portion of the vent duct cover assembly shown in FIG. 2 and FIG. 3.

FIG. 2 is a perspective view of a vent duct cover assembly 50 assembled in a ductless configuration that can be used with vent duct 12 (shown in FIG. 1). FIG. 3 is a perspective view of vent duct cover assembly 50 assembled in a ducted configuration. FIG. 4 is a perspective view of a portion of vent duct cover assembly 50 shown in FIGS. 2 and 3.

Vent duct cover assembly 50 includes a first cover portion 62 and a second cover portion 72. First cover portion 62 includes a substantially solid outer surface 64 having a first cross-sectional profile 68. Second cover portion 72 includes a first end 77, a second end 78, and an outer surface 74 having a second cross-sectional profile 75 similar to first cross-sectional profile 68. Second cover portion 72 further includes a plurality of openings 76 extending through outer surface 74 at first end 77. In the exemplary embodiment, both first cover portion 62 and second cover portion 72 are fabricated from stainless steel metal.

Second cover portion 72 is slidably coupled to first cover portion 62. In one embodiment, vent duct cover assembly 50 is assembled in the ductless configuration as shown in FIG. 2. Second end 78 of second cover portion 72 is positioned within first cover portion 62, and openings 76 at first end 77 are in flow communication with vent duct 12 (shown in FIG. 1), such that gases are dischargeable from vent duct 12 to the environment through openings 76. A lower surface 65 of first cover portion 62 contacts upper surface 24 (shown in FIG. 1) of range hood 10 (shown in FIG. 1), and an upper surface 79 of second cover portion 72 contacts ceiling 26 (shown in FIG. 1). First cover portion 62 extends over outer surface 74 of second cover portion 72, and second cover portion 72 extends from first portion 62 to fit between range hood 10 and ceiling 26. First cover portion 62 includes a first coupling apparatus 66, such as a plurality of fasteners, and second cover portion 72 includes a second coupling apparatus 80. First coupling apparatus 66 is coupled with second coupling apparatus 80 such that first cover portion 62 is secured to second cover portion 72.

In another embodiment, vent duct cover assembly 50 is assembled in the ducted configuration as shown in FIG. 3. Second cover portion 72 is rotated 180 degrees with respect to its position in the ductless configuration, such that first end 77 of second cover portion 72 is positioned within first cover portion 62, and openings 76 are covered by first cover portion 62. Second cover portion 72 is selectively positioned with respect to first cover portion 62 such that first cover portion 62 substantially covers openings 76 on second cover portion 72. First cover portion 62 is also configured to contact range hood 10 (shown in FIG. 1), and second cover portion 72 is also configured to contact ceiling 26 (shown in FIG. 1). In the exemplary embodiment, first portion 62 and second portion 72 have a substantially similar cross-sectional profile that is also substantially similar to cross-sectional profile 28 of vent duct 12.

Vent duct cover 50 facilitates providing a single duct cover which can be used in a plurality of appliance applications operating in either a ductless or ducted configuration. Accordingly, the vent duct cover described herein facilitates reducing fabrication costs by eliminating the need to fabricate duct covers having a different operational configuration, and thereby increases the flexibility to meet different demands while reducing the quantity of parts that must be maintained by the appliance vendors and also reducing the likelihood of an incorrect vent duct cover being installed.

Exemplary embodiments of a vent duct cover are described above in detail. The vent duct cover is not limited to the specific embodiments described herein, but rather, components of the vent duct cover may be utilized independently and separately from other components described herein. Each portion of the vent duct cover can also be used in combination with other vent duct components.

While the invention has been described in terms of various specific embodiments, those skilled in the art will recognize that the invention can be practiced with modification within the spirit and scope of the claims.

What is claimed is:

1. A method for assembling an appliance vent duct cover assembly, said method comprising:

providing a first cover portion having a first cross-sectional profile;

slidably coupling a second cover portion defining a plurality of openings to the first cover portion forming a vent duct cover defining an upstream end and a downstream end, the second cover portion having a second cross-sectional profile substantially similar to the first cross-sectional profile; and selectively positioning a first end portion of the second cover portion within the first cover portion such that a first end portion of the first cover portion substantially covers the second cover portion openings in a first orientation facilitating venting gases through the downstream end, and an opposing second end portion of the second cover portion within the first cover portion such that the second cover portion openings are substantially unobstructed in a second orientation facilitating venting the gases through the plurality of openings.

2. A method in accordance with claim 1 wherein the first cross-sectional profile defines a first cross-sectional area and the second cross-sectional profile defines a second cross-sectional area that is smaller than the first cross-sectional area, said slidably coupling the second cover portion to the first cover portion further comprises positioning the second cover portion at least partially within the first cover portion.

3. A method in accordance with claim 1 wherein slidably coupling the second cover portion and the first cover portion further comprises slidably coupling the first cover portion and the second cover portion such that a lower surface of the first cover portion contacts an upper surface of a range hood and such that an upper surface or the second cover portion contacts a ceiling.

4. A method in accordance with claim 1 further comprising securing the first cover portion to the second cover portion using at least one fastener.

5. An appliance vent duct cover assembly comprising:

a first cover portion having a first cross-sectional profile; and a second cover portion comprising a plurality of openings extending therethrough, said second cover portion slidably coupled to said first cover portion and having a second cross-sectional profile substantially similar to the first cross-sectional profile, a first end portion of said second cover portion is selectively positionable within said first cover portion to enable said plurality of openings to be substantially covered by said first cover portion in a first orientation facilitating venting gases through said second cover portion, and an opposing second end portion of the second cover portion is selectively positionable within said first cover portion such that said plurality of openings are substantially unobstructed in a second orientation facilitating venting gases through said plurality of openings.

6. An appliance vent duct cover assembly in accordance with claim 5 wherein said first cross-sectional profile defines a first cross-sectional area and said second cross-sectional profile defines a second cross-sectional area that is smaller than said first cross-sectional area.

7. An appliance vent duct cover assembly in accordance with claim 5 wherein at least a portion of said second cover portion is positioned at least partially within said first cover portion.

8. An appliance vent duct cover assembly in accordance with claim 5 wherein said first cover portion comprises a stainless steel material, said second cover portion comprises a stainless steel material.

9. An appliance vent duct cover assembly in accordance with claim 5 wherein said first cover portion comprises a first coupling apparatus, said second cover portion comprises a second coupling apparatus configured to couple to said first coupling apparatus.

10. An appliance vent duct cover assembly in accordance with claim 5 wherein said first cover portion is configured to contact a range hood and said second cover portion is configured to contact a ceiling.

11. An appliance vent duct cover assembly in accordance with claim 5 wherein said second cover portion comprises a plurality of openings in flow communication with a vent duct.

12. An appliance vent duct cover assembly in accordance with claim 5 wherein said second cover portion comprises a first end and a second end, said first end positioned at least partially within said first cover portion to enable said openings to be substantially covered by said first cover portion, or said second end positioned at least partially within said first cover portion to enable said openings to be in flow communication with a vent duct.

13. An appliance range hood comprising:

a vent duct coupled to said range hood and extending from an upper surface of said range hood at least partially towards a ceiling; and a vent duct cover assembly at least partially circumscribing said vent duct, said vent duct cover assembly comprising:

a first cover portion; and a second cover portion comprising a plurality of openings defined therethrough, said second cover portion slidably coupled to said first cover portion defining a downstream end and an upstream end, said second cover portion is selectively positionable with respect to said first cover portion such that said plurality of openings are substantially covered by said first cover portion in a first orientation facilitating venting gases through said downstream end, and said plurality of openings are substantially unobstructed in a second orientation facilitating venting gases through said plurality of openings.

14. An appliance range hood in accordance with claim 13 wherein said first cover portion comprises an outer surface having a first cross-sectional area, said second cover portion comprises an outer surface having a second cross-sectional area that is smaller than said first cross-sectional area.

15. An appliance range hood in accordance with claim 13 wherein at least a portion of said second cover portion is positioned at least partially within said first cover portion.

16. An appliance range hood in accordance with claim 13 wherein said first cover portion comprises a stainless steel material, said second cover portion comprises a stainless steel material.

17. An appliance range hood in accordance with claim 13 wherein said first cover portion comprises a first coupling apparatus, said second cover portion comprises a second coupling apparatus configured to couple to said first coupling apparatus.

18. An appliance range hood in accordance with claim 13 wherein said first cover portion extends at least partially over an outer surface of said second cover portion such that said second cover portion is selectively extended from said first portion to fit between said range hood and a ceiling.

19. An appliance range hood in accordance with claim 13 wherein said second cover portion comprises a plurality of openings coupled in flow communication with a vent duct.

20. An appliance range hood in accordance with claim 13 wherein said second cover portion comprises a first end and a second end, said first end positioned at least partially within said first cover portion to enable said plurality of openings to be substantially covered by said first cover portion, said second cover portion positioned at least partially within said first cover portion to enable said plurality of openings to be coupled in flow communication with a vent duct.

* * * * *